United States Patent [19]

Larson

[11] 4,389,741

[45] Jun. 28, 1983

[54] WATERBED FRAME ASSEMBLY

[76] Inventor: Lynn D. Larson, 6501 Park Crest, Lincoln, Nebr. 68506

[21] Appl. No.: 238,434

[22] Filed: Feb. 26, 1981

[51] Int. Cl.[3] ..... A47C 19/00; A47C 27/08

[52] U.S. Cl. ..... 5/400; 5/451; 5/460

[58] Field of Search ..... 5/451, 400, 401, 452, 5/460, 474

[56] References Cited

U.S. PATENT DOCUMENTS 4,057,862 11/1977 La Bianco ..... 5/451

OTHER PUBLICATIONS

"Waterworth 131", Trade Brochure, available from Waterworth 19520, So. Normandie, Torrance, Calif. 90502.

*Primary Examiner*—Alexander Grosz

*Attorney, Agent, or Firm*—Zarley, McKee, Thomte, Voorhees & Sease

[57] ABSTRACT

A waterbed assembly having a horizontal base attached at its periphery to a vertical containing wall forming an open coffer box capable of accepting a waterbed mattress is disclosed. An internal cavity in the containing wall is adapted to allow sheets and bedding to be tucked therein. The containing wall is provided with cushioning material to allow comfortable seating on the periphery of the waterbed assembly. A contoured mattress cover is also disclosed which covers the waterbed assembly and gives the appearance of a conventional mattress and box springs.

7 Claims, 5 Drawing Figures

WATERBED FRAME ASSEMBLY

BACKGROUND OF THE INVENTION

Waterbeds have been increasingly popular during the past decade as a comfortable, relatively inexpensive alternative to conventional beds. Most waterbeds consist essentially of an open box type waterbed frame which laterally supports a waterbed mattress.

Several annoying features have, however, limited the desirability of waterbeds to the general consumer. Because of the great flexibility of the waterbed mattress, it is difficult to keep bedding securely tucked in around the edges of the mattress. Further compounding the problem is the weight of the filled waterbed mattress which complicates tucking the sheets and bedding between the mattress and the base of the frame. Another undesirable feature of waterbeds has been the lack of a comfortable sitting surface around the edge of the bed. With most waterbeds, a person is forced to sit on the edge of one of the verticle wooden planks which form the sides of the frame. The seating on such a frame is uncomfortable at best. Sitting on the waterbed mattress itself is difficult because the mattress, if normally inflated, is not sufficiently firm to stably support a person in a seated position. A person attempting to sit on the waterbed mattress may end up falling backwards onto the bed.

Other attempts have been made to remedy the drawbacks described above, but in most cases, only one of the problems is solved. Other waterbed assemblies that ostensibly overcome both of these problems create new problems, either in the use of the waterbed or in the cost of production.

SUMMARY OF THE INVENTION

The waterbed assembly of the present invention is a relatively simple and inexpensive frame design which provides a solution to the problems discussed above without sacrificing other desirable features of the waterbed. Sheets and bedding may be securely tucked into the sides of the frame and the waterbed user is provided a comfortable polyurethane cushion around the edge of the assembly to sit on. The eight wall members and single base board which comprise the waterbed assembly can be conveniently shipped or stored, and are easily assembled at the desired location.

Accordingly, the primary object of the present invention is to provide a waterbed assembly wherein the sheets and bedding may be securely tucked into the containing wall and wherein a person may sit comfortably and stably on the edge of the containing wall.

A further object of the invention is to provide a waterbed assembly which is relatively inexpensive to produce.

A further object of the invention is to provide a waterbed assembly which is comprised of components which may be stored in a compact space.

A further object of the invention is to provide a waterbed assembly which is comprised of components which may be easily assembled.

A further object of the invention is to provide a waterbed assembly with a padded exterior.

A further object of the invention is to provide a waterbed assembly with a contoured cover which creates the appearance of a conventional bed.

A further object of the invention is to provide a waterbed assembly which forms an open coffer box capable of accepting and supporting a waterbed mattress of similar size and shape.

A further object of the invention is to provide a waterbed assembly with a design which may be used compatably with a waterbed liner and a waterbed heater.

DESCRIPTION OF THE PREFERRED EMBODIMENTS

Figure 1:
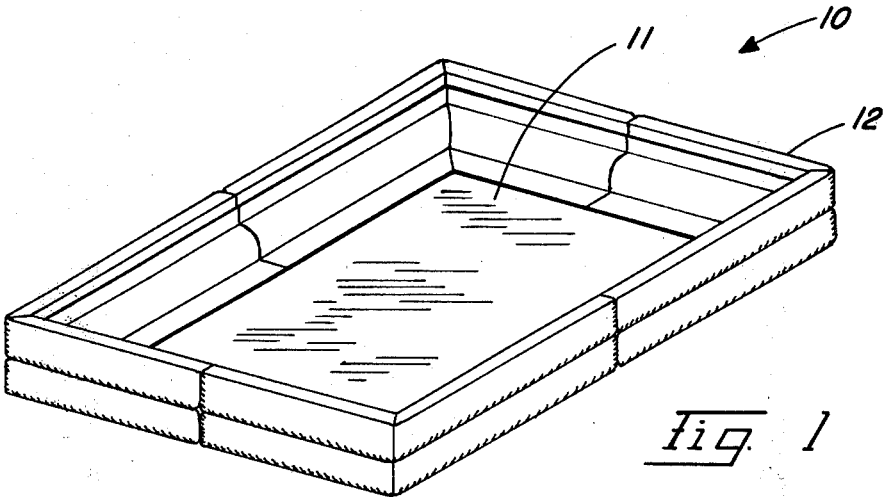
FIG. 1 is a perspective view of the waterbed frame.

The waterbed frame 10 of the preferred embodiment is comprised of a rigid horizontal base 11 connected to a containing wall 12 as shown in FIG. 1. The area circumscribed by the base 11 and wall 12 is an open coffer box of a generally rectangular shape. The coffer box accommodates a waterbed mattress of the same general shape and surface dimensions as the inside dimensions of the box. Although a rectangular shape is used in the preferred embodiment, other shapes are also within the scope of the invention claimed.

As used in this description, "inside" will refer to any surface of the containing wall 12 which would generally come into contact with the lateral periphery of a waterbed mattress placed in the coffer box and "outside" refers to the surface around the periphery of the frame 10. "Interior" refers to surfaces within the containing wall 12 itself.

Figure 3:
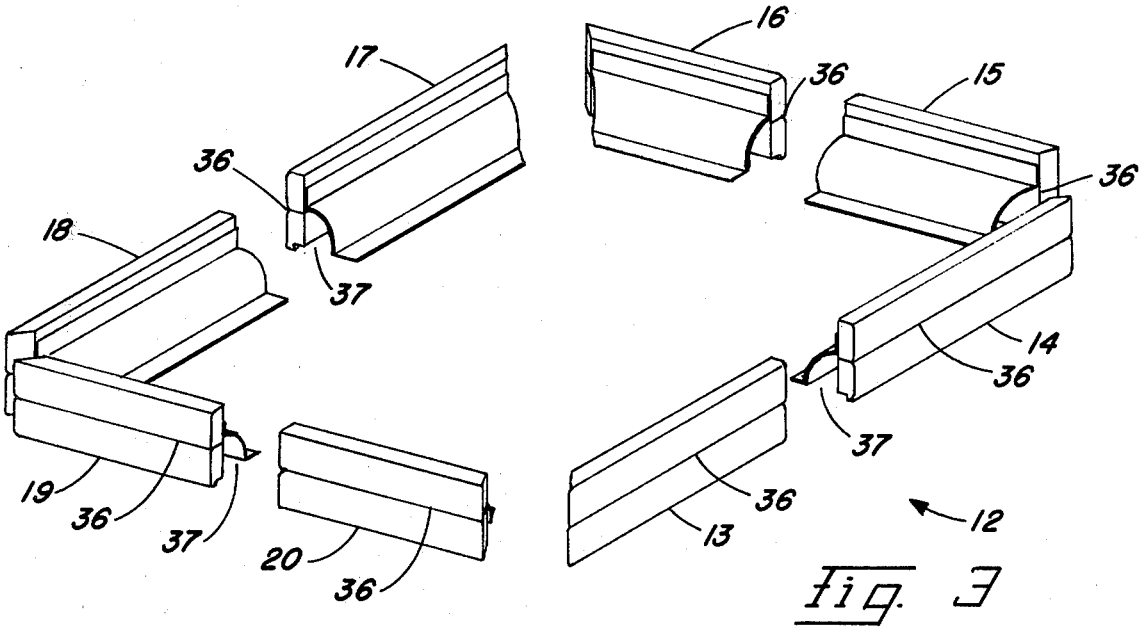
FIG. 3 is an exploded perspective view of the containing wall of the waterbed frame.

The containing wall 12 of the waterbed frame 10 consists of eight elongate partitions 13, 14, 15, 16, 17, 18, 19 and 20, as shown by FIG. 3, having four separate shapes. The partitions at the end and head of the waterbed frame 10 are shorter than the partitions used on the sides of the waterbed frame 10. Th end of each partition is beveled to accommodate connection at each corner of the waterbed frame 10. Partitions, which when viewed from the outside of the frame 10 have a beveled end at the left hand end are arbitrarily designated left-hand partitions. The partitions having a beveled end at the right-hand side when similarly viewed are designated right-hand partitions. Thus, it can be seen that for the construction of a typical rectangular waterbed as depicted in the preferred embodiment, four different partition shapes are used: left-hand side pieces 13, 17, right-hand side pieces 14, 18, left-hand end pieces 15, 19 and right-hand end pieces 16, 20. The use of eight small partitions rather than four large partitions greatly facilitates storage and shipping of a waterbed frame 10. However, where it is desired to use a waterbed frame 10 without a base 11, by placing the waterbed mattress directly on the floor area circumscribed by the containing wall 12, the partitions should be fabricated in four lengths rather than eight in order to maintain the structural integrity of the containing wall 12.

Figure 4:
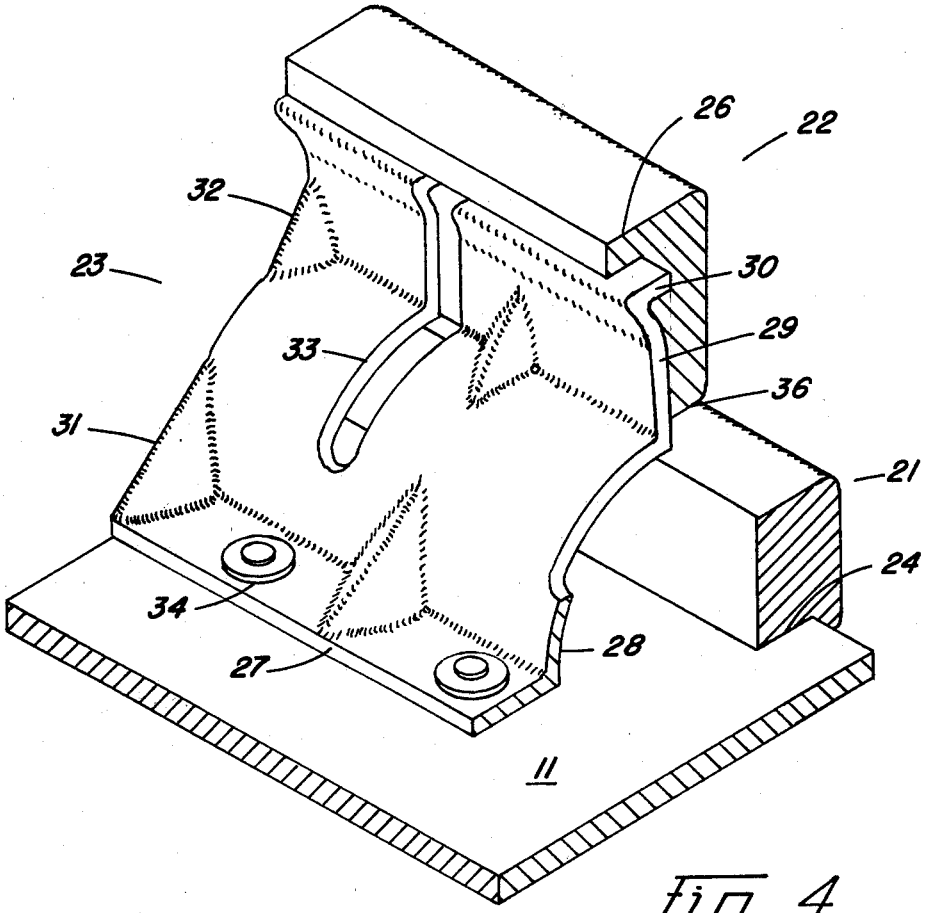
FIG. 4 is a perspective cut away view of the containing wall construction.
Figure 5:
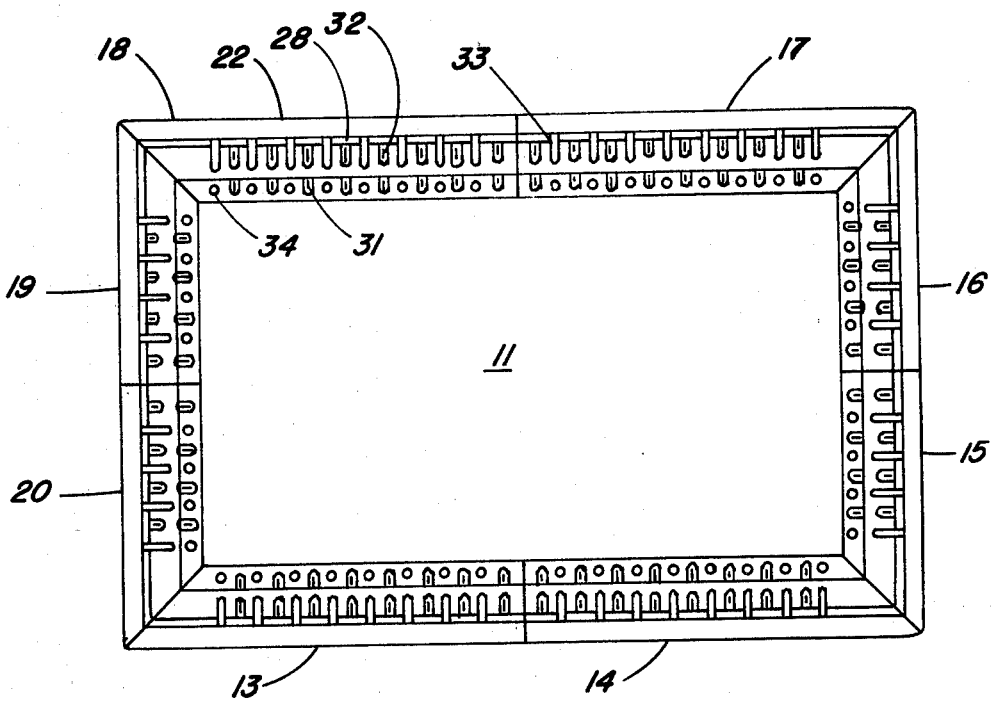
FIG. 5 is a top view of the waterbed frame.

As shown in FIG. 4, each partition 13–20 is made up of a lower horizontal member 21, an upper horizontal member 22, and a flexing member 23. The lower horizontal member in the preferred embodiment is a wooden board of substantially the same size as a conventional 2×4. A rectangular notch 24 may be cut in the bottom of the lower horizontal member 21 in order to accommodate the base 11. The base 11 in the preferred embodiment may be a piece of plywood or particle board of sufficient thickness and strength to maintain the wall 12 in proper alignment when it is subjected to the outward forces exerted by a conventional waterbed mattress. The base 11 may be attached to each lower horizontal member by glue, nails, screws, or any conventional attachment means.

The upper horizontal member 22 has a vertical outside surface parallel to and aligned with the outside surface of the lower horizontal member 21. A horizontal flange 26 projects inwardly from the top of the upper horizontal member 22. The upper surface of the horizontal flange 26 is approximately the same height as the upper surface of a waterbed mattress (not shown) placed within the frame. The upper horizontal member 22 is composed of a resilient material such as polyurethane foam in order to provide a comfortable seating surface to anyone sitting on the edge of the waterbed frame 10. The flexing member 23 is composed of an elastic material such as molded urethane plastic. The flexing member 23 has a lower horizontal flange 27 which is connected to the base 11 by means of rivets 34 or by other connection means well known in the art. The flexing member 23 also has an arcuate section 28 which in the preferred embodiment has a quadrant shape projecting up from the base and contacting the upper edge of the lower horizontal member 21. An upper vertical flange 29 extends from the arcuate section 28 substantially in alignment with the inside vertical wall of the lower horizontal member 21. The vertical flange 29 is glued or otherwise attached along its outside surface to the inside surface of the upper horizontal member 22. A relief bend 30 at the top of the vertical flange 29 lies within a generally horizontal plane and is glued or otherwise attached to the lower surface of the upper horizontal member flange 26. Flexing member upper ribs 32 positioned on the inside surface of the flexing member 23 at the intersection of the arcuate section 28 and the upper flange 29 reduces flexing of the upper flange in an outward direction. Similarly, flexing member lower ribs 31 positioned on the outer surface of the stiffening member 23 at the intersection of the arcuate section 28 and the lower flange 27 prevent outward flexing of the member 23 along this line of intersection. Flexing member cutouts 33 spaced at 3 to 8 inch intervals along the length of the flexing member and extending from the top of the member 23 to a point midway down the arcuate section 28 of the member 23 allows localized bending of the member 23 without a distortion to the member 23 along its entire length. In the preferred embodiment, the flexing member 23 has been formed from a ram injection mold process.

As can be seen from FIG. 4, in the preferred embodiment, the line of intersection between the flexing member vertical flange 29 and flexing member arcuate section 23 rests on the upper surface of the lower horizontal member 21. A vertical load placed on the upper surface of the upper horizontal member 22 is thus supported primarily by the compressive strength of the flexing member upper vertical flange 29 and the lower horizontal member 21. The plastic material used in forming the flexing member 23 must, thus, have sufficient compressive strength to support the type of vertical load produced by a person sitting on the edge of the waterbed frame 10. Bedding material such as sheets and blankets which are used on the waterbed are tucked into the cavity 37 enclosed by the flexing member 23 lower horizontal member 21 and base 11 as shown in FIGS. 3 and 4. A continuous horizontal slit 36 is formed by the positioning of the upper horizontal member 22 on top the lower horizontal member 21. This slit 36 may be expanded by raising the upper horizontal member 22 with respect to the lower horizontal member 21 in order to allow bedding material to be tucked into the cavity 37. The flexing member 23 must, thus, be sufficiently flexible to allow the slit 36 to be opened while remaining sufficiently stiff and elastic to cause the slit to be reclosed and to firmly hold bedding material in position once it has been tucked into the cavity 37.

Figure 2:
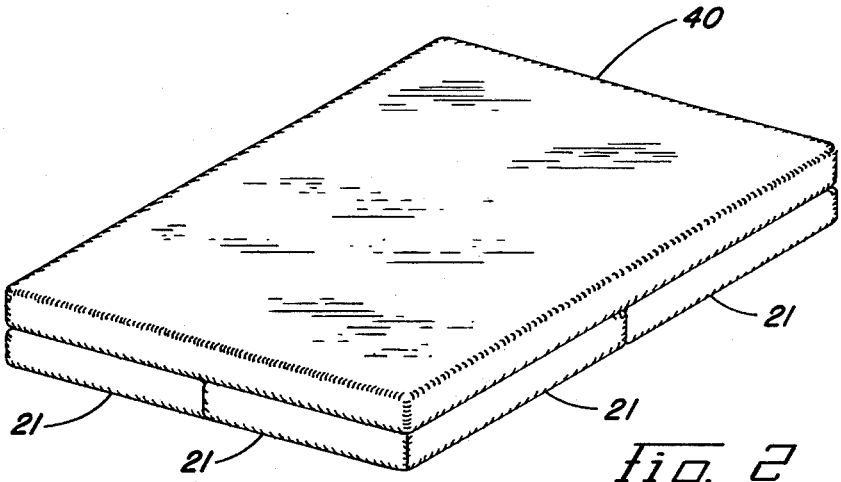
FIG. 2 is a perspective view of the waterbed frame fitted with a contoured cover.

It can be seen from the above description that a waterbed frame 10 is provided which allows comfortable seating along the upper edge of the waterbed containing wall 12. Sheets and bedding material may be conveniently tucked into a cavity 37 within the containing wall 12 through a continuous horizontal slit 36 which circumscribes the containing wall 12. A flexing member 23 is provided which allows small sections of the wall to be raised for inserting bedding while firmly holding the surrounding bedding in place. Flexing member 23 is sufficiently resilient to allow a slight inward flexing in the upper horizontal member 23 as the bedding material and upper surface of a waterbed are distorted by a person sleeping thereon. The moderate distortion of the upper horizontal member thus allowed approximates the distortion of a conventional mattress and avoids the "trampoline effect" which is produced by waterbed frames which utilize a cover that is rigidly mounted on the frame. A contour cover 40 as shown in FIG. 2 may be used to cover the waterbed to create the appearance of a conventional mattress and box springs. Covering material (not shown) may be added to the outer surface of the lower horizontal member 21 to further simulate the appearance of a conventional bed.

The waterbed assembly described above and in the claims provides features found in conventional bedding without sacrificing any of the desirable characteristics of waterbeds. The frame may be sold in an easily assembled kit and may be stored or shipped with minimal trouble because of its compact size and shape when broken into components.

Although specific components, proportions and process steps are stated in the above description of the preferred embodiment of the invention; other suitable materials, proportions and process steps, as listed herein, may be used with satisfactory results and varying degrees of quality. In addition, it will be understood that various other changes of the details, materials, steps, arrangement of parts and uses which have herein been described and illustrated in order to explain the nature of the invention will occur and may be made by those skilled in the art, upon a reading of this disclosure, and such changes are intended to be included within the principles and scope of this invention.

I claim:

1. A frame for a waterbed comprising:

a base;

a containing wall connected to said base at the periphery of said base whereby said base and said containing wall form an open coffer box capable of accepting and supporting a waterbed mattress;

an internal cavity within said containing wall for accepting sheets and other bedding used on a waterbed;

opening means for inserting sheets and other bedding into said enclosed space;

said containing wall is comprised of a plurality of elongate wall sections;

each elongate wall section comprising:

(a) a horizontally extending vertically upright lower member;

(b) a horizontally extending vertically upright upper member positioned above said lower member to form a vertical wall with a continuous horizontal slit therein; and (c) a horizontally extending flexing member positioned inwardly of said upper and lower members;

said flexing member being disposed in intersecting angularity with said upper member and wherein said flexing member has a top and a bottom and wherein the top of said flexing member is fixedly attached to said upper member and wherein the bottom of said flexing member is fixedly attached to said base.

2. The waterbed frame of claim 1 wherein said internal cavity for accepting sheets and bedding comprises the space enclosed by said lower member, said upper member, said flexing member and said base.

3. The waterbed frame of claim 2 wherein said opening means comprises said slit between said upper member and said lower member.

4. The waterbed frame of claim 3 wherein said upper member comprises a padding means on the upper surface of said upper member to provide cushioned seating on said containing wall.

5. The waterbed frame of claim 4 wherein said stiffening member is comprised of plastic sheet material comprising a horizontal bottom flange attached to said base; an arcuate middle section; a vertical upper flange attached to said upper member; a relief bend at the top of said vertical upper flange for supporting said padding means in said upper member; and spaced vertical cut out sections for increasing flexibility in said flexing member.

6. The waterbed frame and cover of claim 5 further comprising covering material attached to the outer surface of said lower member to simulate the appearance of a conventional bed.

7. A frame for a waterbed comprising:

a containing wall which may be placed on any flat supporting surface to form an open coffer box for supporting a waterbed mattress;

an internal cavity within said containing wall for accepting sheets and other bedding used on a waterbed;

opening means for inserting sheets and other bedding into said internal cavity;

said containing wall being comprised of a plurality of elongate wall sections and wherein each elongate wall section comprises:

(a) a horizontally extending vertically upright lower member;

(b) a horizontally extending vertically upright upper member positioned above said lower member to form a vertical wall with a continuous horizontal slit therein;

(c) a horizontally extending flexing member positioned inwardly of said upper and lower members and attached at its upper surface to said upper member; and (d) a horizontally extending flat connecting member attached to the lower surface of said flexing member and also attached to the lower surface of said lower member.

* * * * *

UNITED STATES PATENT AND TRADEMARK OFFICE

CERTIFICATE OF CORRECTION

PATENT NO. : 4,389,741

DATED : June 28, 1983

INVENTOR(S) : Lynn D. Larson, et al

It is certified that error appears in the above-identified patent and that said Letters Patent are hereby corrected as shown below:

On the title page;

Add: "Ronald Lee Larson, Lincoln, Nebraska" as a joint inventor with the originally listed sole inventor Lynn D. Larson.

Signed and Sealed this

*Seventeenth* Day of *September 1985*

[SEAL]

*Attest:*

*Attesting Officer*

DONALD J. QUIGG

*Commissioner of Patents and Trademarks—Designate*